US008757034B2

(12) United States Patent
Skogerboe et al.

(10) Patent No.: US 8,757,034 B2
(45) Date of Patent: Jun. 24, 2014

(54) OXYGEN SENSOR TOOL AND METHOD FOR INSTALLATION AND REMOVAL OF AN OXYGEN SENSOR

(75) Inventors: Dirk Skogerboe, Faribault, MN (US); Scott Krampitz, Owatonna, MN (US); Dennis Hanson, Medford, MN (US)

(73) Assignee: Bosch Automotive Service Solutions LLC, Warren, MI (US)

( * ) Notice: Subject to any disclaimer, the term of this patent is extended or adjusted under 35 U.S.C. 154(b) by 188 days.

(21) Appl. No.: 13/118,784

(22) Filed: May 31, 2011

(65) Prior Publication Data

US 2012/0304833 A1 Dec. 6, 2012

(51) Int. Cl.

| | |
|---|---|
| ***B25B 23/16*** | (2006.01) |
| ***B25B 13/48*** | (2006.01) |
| ***B25G 1/06*** | (2006.01) |
| ***B25G 3/38*** | (2006.01) |

(52) U.S. Cl.
USPC ..... 81/119; 81/177.7

(58) Field of Classification Search
USPC ..... 81/125.1, 119, 121.1, 177.1, 177.2, 81/177.7
See application file for complete search history.

(56) References Cited

U.S. PATENT DOCUMENTS

| | | | | | |
|---|---|---|---|---|---|
| 2,886,998 | A * | 5/1959 | Scott | 81/177.9 |
| 4,724,731 | A * | 2/1988 | Onofrio | 81/119 |
| 5,568,757 | A * | 10/1996 | Lewis | 81/177.2 |
| 5,706,709 | A * | 1/1998 | Snow | 81/73 |
| 5,823,077 | A * | 10/1998 | Macor | 81/177.1 |
| 6,112,625 | A * | 9/2000 | Turtle | 81/177.2 |
| 6,138,533 | A * | 10/2000 | Turtle | 81/124.3 |
| D473,767 | S * | 4/2003 | Olson | D8/28 |
| 7,024,973 | B2 * | 4/2006 | Kobert et al. | 81/463 |
| 7,036,402 | B1 * | 5/2006 | Marks et al. | 81/177.2 |
| D549,535 | S * | 8/2007 | Yang | D8/29 |
| 7,444,908 | B2 * | 11/2008 | Lin | 81/438 |
| 2005/0274232 | A1 * | 12/2005 | Wu | 81/177.1 |
| 2007/0051212 | A1 * | 3/2007 | Hsieh | 81/177.7 |
| 2008/0289460 | A1 * | 11/2008 | Whitehead et al. | 81/463 |
| 2009/0078093 | A1 * | 3/2009 | Suski et al. | 81/121.1 |
| 2012/0297937 | A1 * | 11/2012 | Evans | 81/121.1 |

* cited by examiner

*Primary Examiner* — David B Thomas
(74) *Attorney, Agent, or Firm* — Baker & Hostetler LLP

(57) ABSTRACT

A work piece turning tool is provided. The tool includes: a body having two ends; a gripper located at one end configured to grip a work piece; a handle located at the end opposite of the gripper; and tool attachment located at a base of the handle at the end of the tool, wherein the tool attachment includes both an exterior drive and an interior drive. A method of turning a work piece is provided. The method includes: attaching a first tool having a movable gripper end to the work piece; attaching a second tool to a drive mounted to the handle of the first tool; moving the first tool to a desired orientation with respect to the gripper; and turning the work piece by moving the second tool.

16 Claims, 2 Drawing Sheets

OXYGEN SENSOR TOOL AND METHOD FOR INSTALLATION AND REMOVAL OF AN OXYGEN SENSOR

FIELD OF THE INVENTION

The present invention relates generally to a tool for turning a work piece or fastener. More particularly, the present invention relates to a tool having a flexible wrench head and a tool attachment at the other end in order to allow a second tool to attach to the tool to provide additional leverage or torque.

BACKGROUND OF THE INVENTION

Fasteners and other work pieces that are desired to be turned such as, for example, an oxygen sensor can be located in an area that is difficult to reach or turn. For example, oxygen sensors have a tendency to seize due to heat and corrosion and may be very difficult to remove. An oxygen sensor may be placed in a vehicle near an exhaust manifold and warrants a flexible head socket or wrench in order to reach and turn the oxygen sensor.

Once the work piece such as the oxygen sensor is properly engaged, it may still be difficult to turn due to corrosion or other factors. Therefore, it is desirable to have a tool that can be flexible enough to engage a work piece that is desired to be turned in an inconvenient location and have the tool to be able to generate enough torque or leverage to turn the work piece.

Accordingly, it is desirable to provide a tool that can be flexible to engage a fastener or work piece in hard to reach locations and provide enough torque to turn the fastener or work piece.

SUMMARY OF THE INVENTION

The foregoing needs are met, to a great extent, by the present invention, wherein in one aspect an apparatus and or method is provided in some embodiments to allow the difficult to reach and or turn work piece to be properly engaged and provide enough torque or leverage to turn the work piece.

In accordance with one embodiment of the present invention, a work piece turning tool is provided. The tool includes: a body having two ends; a gripper located at one end configured to grip a work piece; a handle located at the end opposite of the gripper; and tool attachment located at a base of the handle at the end of the tool, wherein the tool attachment includes both an exterior drive and an interior drive.

In accordance with another embodiment of the present invention, a method of turning a work piece is provided. The method includes: attaching a first tool having a movable gripper end to the work piece; attaching a second tool to a drive mounted to the handle of the first tool; moving the first tool to a desired orientation with respect to the gripper; and turning the work piece by moving the second tool.

In accordance with yet another embodiment of the present invention, a fastener turning tool is provided. The tool includes: a body having two ends; a means for gripping a fastener located at one end configured to grip a work piece; a handle located at the end opposite of the means for gripping; and means for attaching a tool located at a base of the handle at the end of the tool, wherein the means for attaching a tool includes both an exterior drive and an interior drive.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
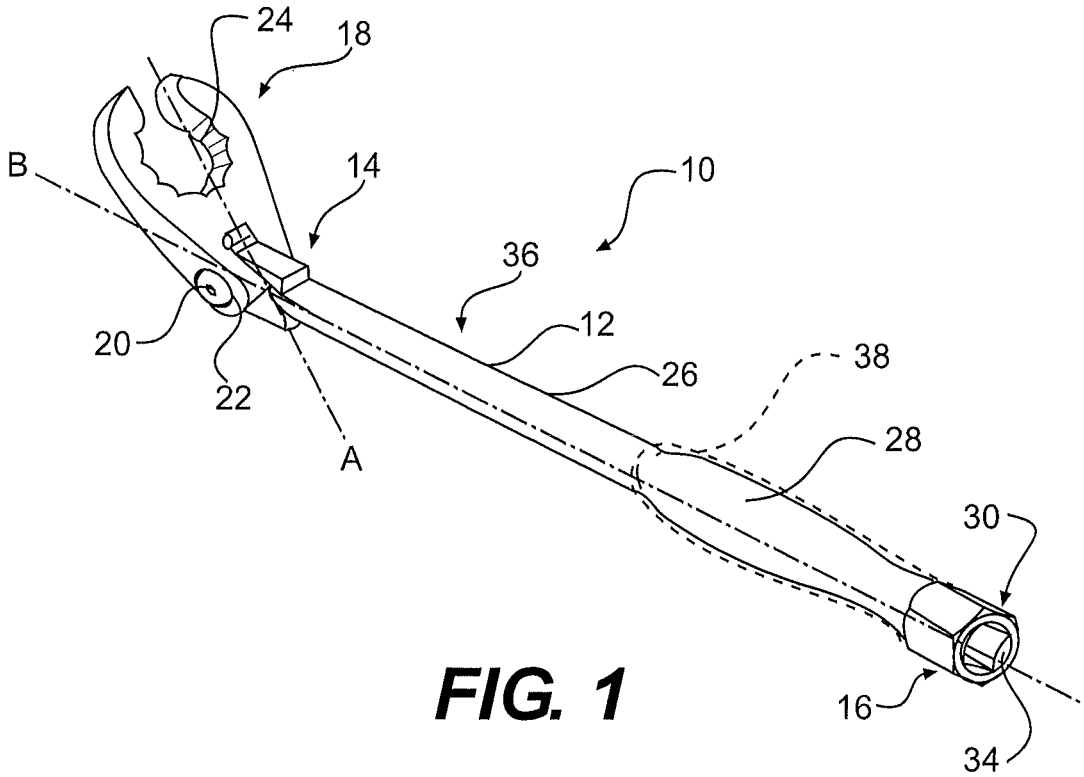
FIG. 1 is a perspective view illustrating a tool according to a preferred embodiment of the invention.

An example embodiment in accordance with the invention will now be described with reference to the drawing figures, in which like reference numerals refer to like parts throughout.

An embodiment in accordance with the present invention provides a tool that may be able to engage a difficult to reach work piece and provide enough torque or leverage in order to turn the work piece.

For example, as shown in FIG. 1, a tool 10 is provided. While the tool 10 is described and configured to turn an oxygen sensor in an automobile, a tool 10 in accordance with other embodiments of the invention may be used for a variety of purposes, notably turning fasteners or any other work piece that is desired to be turned. As shown in FIG. 1, the tool 10 includes a body 12. The body 12 is primarily elongated and has two ends 14 and 16. At end 14, the body 12 carries a movable gripper 18. The gripper 18 may be pivotal with respect to the body 12.

For example, as shown in FIG. 1, the gripper 18 is pivotally connected to the body 12 via a hinge pin 20 fit into a hinge pin hole 22. The hinge pin 20 allows the gripper 18 to be pivoted to a desired position with respect to the body 12.

Figure 2:
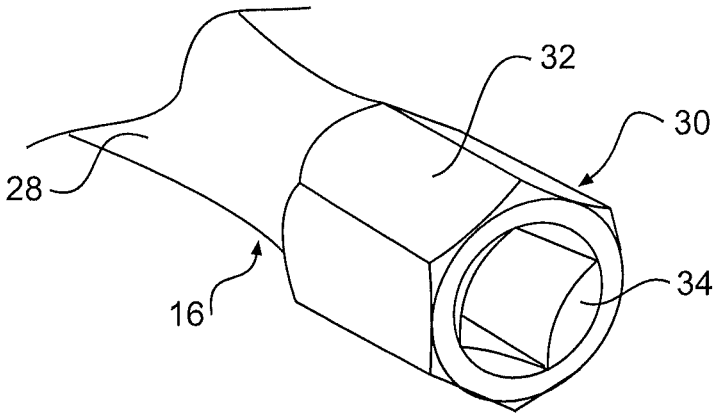
FIG. 2 is a partial close up view of an end of the tool in accordance with an embodiment of the invention.

The gripper 18 also includes and engaging surface or wrench 24. As shown in FIG. 2, the engaging surface 24 is configured to engage a faster or an oxygen sensor or any other work piece that may be desired to be turned. As shown in FIG. 1, the engaging surface 24 is configured to engage a hex or 12-sided fastener or work piece.

In other embodiments, the engaging surface 24 may be in a variety of different shapes and is not limited to that shown in FIG. 1. For example, the engaging surface 24 may be hex shaped, square shaped or any other shape desired to be used to engage a work piece to be turned.

The body 12 includes a shaft 26 and a handle 28 located at the end 16.

At the end of the handle 16 is a tool attachment 30. The tool attachment 30 may be configured to allow a second tool (not shown) to engage the tool attachment 30 to provide additional reach, leverage or torque the tool of 10. In some embodiments, and as shown in FIGS. 1 and 2, tool attachment 30 contains an external drive 32 and an internal drive 34. The tool attachment 30 is shown in the FIG. 2 in a detail view. As shown in FIGS. 1 and 2 the external drive 32 is an external hex drive. In some embodiments of the invention, the external hex drive 32 is a ⅝ inch drive.

However, this is an example dimension, and is not limiting. Other dimensions including metric dimensions they may be used in accordance with some embodiments of the invention. Further, other drive configurations may also be used rather than hex drives. For example, 12-sided or 4-sided or any other desired external drive thereto may also be used.

The internal drive 34 allows other types of tools to engage the tool attachment 30 as shown in FIGS. 1 and 2, the internal drive 34 is a four-sided internal drive. In some embodiments of the invention, the square internal drive may be a ⅜ inch strive, however, this dimension is meant as an example and is not limiting.

In other embodiments in accordance to the invention, the internal drive 34 may include other sizes. Further, the invention is not limited to a 4-sided internal drive 34 as shown, but other internal drives such as a hex or 12-sided drive or any other desired type of internal drive may also be used in accordance with the invention.

In some embodiments of the invention, the tool 10 may be made of steel and coated with a corrosion resistant coating 36 such as a chrome plating or a zinc coating. In other embodiments of the invention, other corrosion resistant coatings 36 may also be used. Further, in other embodiments of the invention, the tool 10 may be made of other material rather than steel. A suitable tool making material may be used in accordance with the invention.

In other embodiments of the invention, the handle 28 may have a cover 38. The cover 38 may provide a comfortable gripping surface for a user to use when grabbing the handle 28. For example, the cover 38 may be foam, rubber, or any other suitable substance for covering the handle 38 and providing a slip resistant and/or comfortable gripping surface.

Figure 3:
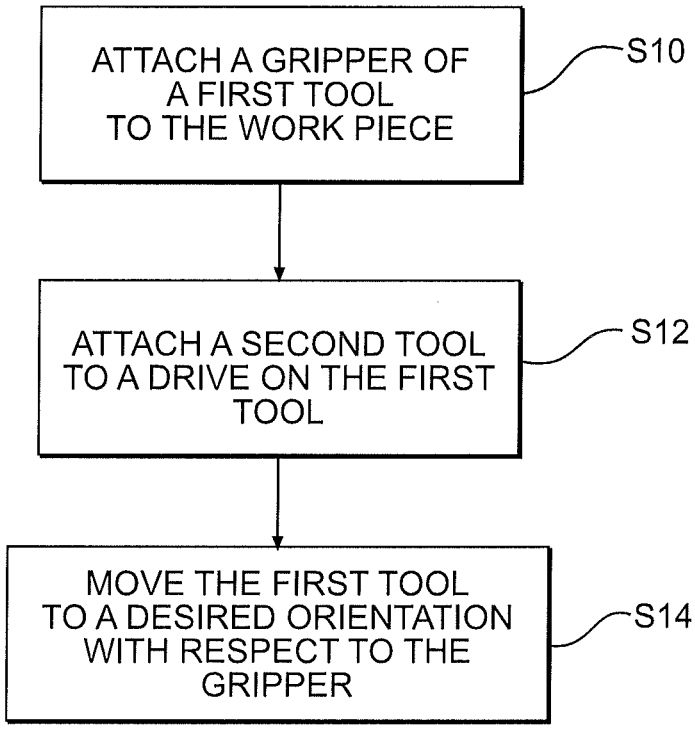
FIG. 3 is a flow chart illustrating steps taken according to an embodiment of the invention.

Turning now to FIG. 3 a method of using the tool 10 in accordance with some embodiment of the invention as described. For example, as described in the step S10, a user may attach a gripper 18 of the tool 10 to a work piece desired to be turned. The user may also attach a second tool to the tool attachment 30 such as a socket, a wrench, a breaker bar or any other suitable type tool to the tool attachment 30 as described in step S12.

As described in S14, the user may move the tool 10 to a desired orientation with respect to the gripper 18 and then actuate or turn a work piece by turning either or both of the first tool 10 and the tool attached to the tool attachment 30.

The above mentioned steps are not necessarily required to be done in any particular order. One in of ordinary skill in the art desiring to turn a work piece, after reviewing this disclosure will know which order to perform the various steps described herein.

In some embodiments of the invention, the desired location of the gripper 18 with respect to the tool 10, may be an orientation where the axis A (shown in FIG. 1) of the gripper 18 is aligned with, or parallel to, the axis B (shown in FIG. 2) of the Tool 10.

In other embodiments of the invention, the desired position of the gripper 18 with respect to the tool 10 and body 12 may be in position where the axis A and axis B are not aligned or parallel as shown in FIG. 1.

Although an example of the device is shown as an oxygen sensor wrench, it will be appreciated that other types of tools can be adapted according to other embodiments of the invention.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A work piece turning tool, comprising:
a body having first and second ends;
a gripper pivotally connected at the first end and configured to grip a work piece in order to turn the work piece about an axis;
a handle located near the second end; and
a tool attachment located at the second end of the tool,
wherein the tool attachment includes both an exterior drive and an interior drive.

2. The tool of claim 1, wherein the exterior drive is a hex drive.

3. The tool of claim 2, wherein the exterior hex drive is a ⅝ inch drive.

4. The tool of claim 1, wherein the interior drive is a square drive.

5. The tool of claim 4, wherein the interior square drive is a ⅜ inch square drive.

6. The tool of claim 1, wherein the gripper is a wrench.

7. The tool of claim 6, wherein the wrench is movable with respect to the body.

8. The tool of claim 1, further comprising a corrosion resistant coating on the tool.

9. The tool of claim 8, wherein the corrosion resistant coating includes zinc.

10. The tool of claim 1, further comprising a cushion on the handle.

11. The tool of claim 10, wherein the cushion includes a foam.

12. A method of turning a work piece, comprising:
attaching a movable gripper located at a first end of a body of a first tool, to the work piece;
attaching a second tool to a drive located at a second end of the body, wherein a handle is located near the second end of the body;
moving the body of the first tool to a desired orientation with respect to the movable gripper; and
turning the work piece by moving the second tool, wherein the second tool engages the first tool by fitting over an external drive on the first tool.

13. The method of claim 12, wherein moving the body of the first tool to the desired orientation with respect to the gripper includes pivoting the gripper with respect to the body of the first tool.

14. The method of claim 13, wherein moving the body of the first tool to the desired orientation with respect to the gripper includes pivoting the gripper to a position where an axis of the gripper is aligned with an axis of the body of the first tool.

15. A fastener turning tool comprising:

a body having first and second ends;

means for gripping a fastener, the means for gripping is pivotally connected at the first end and configured to grip a work piece in order to turn the work piece about an axis;

a handle located near the second end; and means for attaching a tool, the means for attaching is located at the second end of the body, wherein the means for attaching the tool includes both an exterior drive and an interior drive.

16. The tool of claim 15, wherein the exterior drive is a hex drive and the interior drive is a square drive.

* * * * *